United States Patent [19]

Becker et al.

[11] Patent Number: 4,559,150

[45] Date of Patent: Dec. 17, 1985

[54] STABLE COMPOSITION FOR TREATING TEXTILE SUBSTRATES

[75] Inventors: Carl Becker; Fritz Heizler, both of Basel, Switzerland

[73] Assignee: Ciba Geigy Corporation, Ardsley, N.Y.

[21] Appl. No.: 519,931

[22] Filed: Aug. 3, 1983

[30] Foreign Application Priority Data

Aug. 11, 1982 [CH] Switzerland ..... 4811/82
May 25, 1983 [CH] Switzerland ..... 2839/83

[51] Int. Cl.[4] ..... D06M 13/00

[52] U.S. Cl. ..... 252/8.6; 8/648; 252/301.21; 427/158

[58] Field of Search ..... 252/8.6, 301.21; 8/648, 8/583, 501; 427/158

[56] References Cited

U.S. PATENT DOCUMENTS

| | | | |
|---|---|---|---|
| 2,881,045 | 4/1959 | Mecco et al. | 8/583 |
| 3,203,753 | 8/1965 | Storburne | 8/616 |
| 3,940,246 | 2/1976 | DeFago et al. | 8/470 |
| 4,029,467 | 6/1977 | DeFago et al. | 8/470 |
| 4,185,962 | 1/1980 | Gerber et al. | 8/171 |
| 4,229,176 | 10/1980 | Schäfer et al. | 8/582 |
| 4,235,597 | 11/1980 | Reinert | 8/526 |

FOREIGN PATENT DOCUMENTS

| | | |
|---|---|---|
| 0058637 | 2/1982 | European Pat. Off. . |
| 1542369 | 3/1979 | United Kingdom . |

OTHER PUBLICATIONS

Chemical Abstract, vol. 91, 1979, p. 82.

*Primary Examiner*—Prince E. Willis
*Assistant Examiner*—Willie J. Thompson
*Attorney, Agent, or Firm*—Edward McC. Roberts; Kevin T. Mansfield

[57] ABSTRACT

A stable composition for treating textile substrates, which composition comprises at least (a) an organic solvent which is sparingly soluble or insoluble in water and in which component (b) is dissolved and components (c) and (d) are dissolved or dispersed, (b) a vehicle for component (c) which is sparingly soluble or insoluble in water, (c) a finishing agent which is sparingly soluble or insoluble in water and which is soluble or dispersible in the vehicle (b), and (d) a water-soluble acid having a pK value greater than 1 and optionally in addition (e) a solid carboxylic acid which is sparingly soluble in water, (f) a polar solvent and/or further additives or assistants, e.g. surfactants or chelating agents.

The novel composition, which preferably contains fluorescent whitening agents as finishing agents, is used in particular for whitening synthetic fibre materials, especially finished goods such as curtains or underwear, in acid medium.

39 Claims, No Drawings

STABLE COMPOSITION FOR TREATING TEXTILE SUBSTRATES

The present invention relates to a stable composition for treating textile substrates, in particular to a novel stable, concentrated or dilute acid-containing liquid formulation of a fluorescent whitening agent for treating fabrics, especially finished goods, e.g. underwear and, in particular, curtains made from synthetic fibres, preferably from polyester fibres.

To whiten non-finished textile material, the normal procedure is to apply e.g. fluorescent whitening agents which are sparingly soluble in water to the textile material by an exhaust process or, in particular, by a pad process, and subsequently to thermofix the material at temperatures above 100° C. This process is virtually inapplicable to made-up goods at elevated temperatures. Attempts to whiten textiles, e.g. polyester curtains, at low temperatures have so far not produced practical results.

The same problem that arises in connection with whitening made-up goods also applies equally to dyeing or finishing these goods, e.g. with microbicides, softeners, UV absorbers, pigments, plasticisers or dirt repellents.

Accordingly, it is the object of the present invention to provide a novel method of application which makes it possible also to finish or dye made-up goods at low temperature or, in particular to whiten them at room temperature.

This object is accomplished by using for the said method of application, especially for whitening natural or synthetic fibre material, preferably polyester textiles or blends containing polyester as main component and, most preferably, curtains made from polyester fibres, specific acid-containing compositions, as described hereinafter. These compositions are most effective and go evenly onto the fibres. They can be added direct to a treatment bath, e.g. a rinsing liquor, and then applied to the substrate, even at room temperature over a short period of time, to give a finish that can be readily washed off with alkali or also, if desired, a permanent finish.

Accordingly, the present invention relates to a stable composition for treating textile substrates, which composition comprises at least (a) an organic solvent which is sparingly soluble or insoluble in water and in which component (b) is dissolved and components (c) and (d) are dissolved or dispersed, (b) a vehicle for component (c) which is sparingly soluble or insoluble in water, (c) a finishing agent which is sparingly soluble or insoluble in water and which is soluble or dispersible in the vehicle (b), and (d) a water-soluble acid having a pK value greater than 1.

In addition to components (a), (b), (c) and (d), the composition of the invention may also comprise (e) a solid carboxylic acid which is sparingly soluble in water and preferably soluble in the solvent (a), and/or (f) a polar solvent as well as further additives or assistants.

Components (a), (b), (c), (d), (e) and (f) may be used as individual compounds or in admixture. Preferred compositions contain components (a), (b), (c), (d) and (e) or, preferably, all the indicated components (a), (b), (c), (d), (e) and (f).

Organic solvents suitable for use as component (a) are preferably those which are volatile, water-insoluble or of only limited solubility in water, and which at the same time are able to form an organophilic or organic liquid phase. Limited solubility in water will be understood as meaning a solubility of up to 15% by weight. However, a water solubility of less than 1%, in particular 0.1%, is preferred, i.e. at most 10 g or 1 g respectively of solvent should dissolve in one liter of water.

Representative examples of such solvents which form a second phase in water are: alcohols containing at least 4 carbon atoms, e.g. n-butanol, isobutanol, sec-butanol, pentanols, hexanols, trimethylhexanol, heptanols, octanols, benzyl alcohol, phenetol, phenoxyethanol, chlorophenoxyethanol, phenyl glycol, cyclopentanol, cyclohexanol; aromatic aldehydes such as benzaldehyde or furfurol; ethers such as diisopropyl ether, ethylene glycol dibutyl ether or diethylene glycol diethyl ether; esters of an aliphatic or aromatic carboxylic acid, e.g. acetates such as B 2-ethylhexyl acetate, isopropyl acetate, methyl isoamyl acetate, butyl acetate, isobutyl acetate, amyl acetate, ethyl glycol acetate, benzyl acetate, acetoacetates, propionates, n-butyl butyrate, dibutyloxalate, adipates e.g. dimethyl or diethyl adipate, sebacates, succinates, malonates, benzoates or salicylates; ketones such as methyl propyl ketone, diisobutyl ketone, methyl isoamyl ketone, ethyl butyl ketone, ethyl amyl ketone, 2-methylcyclohexanone; acetophenone, cyclohexyl ethyl ketone, benzyl ethyl ketone or phenyl ethyl ketone; aromatic mono- or polycyclic hydrocarbons which are unsubstituted or substituted by halogen atoms or nitro groups, e.g. benzene; alkylbenzenes such as toluene, xylene, trimethylbenzene, ethyl benzene or methyl ethyl benzene; chlorobenzenes, nitrobenzene, diphenylalkanes, alkyl-substituted diphenylalkanes, alkyl-substituted diphenyl, chlorodiphenyl, trichlorodiphenyl, dibenzyl toluene, benzylated xylenes, terphenyl, hydrogenated diphenyl or terphenyl, tetralin, naphthalene; aliphatic hydrocarbons having a flash point above 40° C.; halogenated lower aliphatic hydrocarbons such as chloroform, methylene chloride, ethylene chloride, trichloroethane, trichloroethylene or perchloroethylene; polyhalogeated paraffins such as chloroparaffin; and also mesityl oxide, isophoron, benzonitrile, acrylonitrile, hexyl cellosolve or phenyl cellosolve. Mixtures of these solvents can also be used.

Particularly advantageous solvents are those having a flash point above 40° C., preferably above 50° C., which are non-toxic, do not have a strong odour or at least have a pleasant odour, and which can be removed easily and completely. Examples of such solvents are aliphatic hydrocarbons; alkylbenzenes e.g. trimethylbenzene, methyl ethyl benzene or ethyl benzene; hexanols, 2-ethylhexanol, oleyl alcohol, benzyl alcohol, phenoxyethanol; acetates such as hexyl acetate, 2-ethylhexyl acetate, 2-ethylbutyl acetate or cyclohexyl acetate or phenyl acetate; dimalonates, e.g. dimethyl or diethyl malonate; disuccinates, e.g. dimethyl or diethyl succinate; benzoates such as methyl, ethyl or butyl benzoate; dialkyl ketones containing a middle number of carbon atoms, preferably a total of 6 to 12 carbon atoms, e.g. ethyl butyl ketone, diisobutyl ketone, methyl isoamyl ketone or isobutyl heptyl ketone; ethylene glycol dibutyl ethers, e.g. ethylene glycol n-butyl or tert-butyl ether, or ethylene glycol di-tert-butyl ether; perchloroethylene; or mixtures thereof.

Preferred solvents (a) are aliphatic hydrocarbons having a flash point above 50° C. and a boiling point in the range from 175°–260° C., perchloroethylene, diethyl malonates, diethyl succinates, benzyl alcohol, phenoxyethanol, butyl benzoates, or mixtures thereof.

The solvent employed for dissolving the vehicle and which normally forms a second phase in water, is necessary only for the level application of the vehicle to the lipophilic substrate. After the application, the solvent is superfluous and should either evaporate or remain in the rinsing water.

The vehicle (b) can be liquid or solid or consist of a combination of solid and liquid substances. Liquid vehicles are organic lipophilic liquids having an extremely low vapour pressure (≦1 mm at 150° C.), e.g. so-called plasticisers. Particularly useful plasticisers are glycerol triesters such as triacetin, phosphoric acid esters; acyclic (aliphatic) dicarboxylic acid esters, e.g. adipates such as dioctyl adipate, mono- or diphthalates, and also fatty acid esters or epoxy plasticisers.

The ester moiety of phthalic acid esters is derived preferably from aliphatic alcohols containing 1 to 22 carbon atoms. Very suitable phthalic acid esters are dimethyl phthalate, diethyl phthalate, dibutyl phthalate or di-2-ethylhexyl phthalate, di-3,5,5-trimethylhexyl phthalate, dioctyl phthalate or diisononyl phthalate. The most preferred phthalates are the diesters of phthalic acid with alkanols containing 1 to 9 carbon atoms. Also very useful are mixed phthalic acid esters of fatty alcohols containing 6 to 22 carbon atoms, especially stearyl alcohol or $C_8$–$C_{22}$ alfols, and alkylene glycols or alkylene glycol monoalkyl ethers. The alfols are linear primary alkanols. Preferred phthalic acid esters are those of the formula

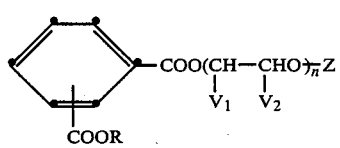

(1)

wherein R is an aliphatic hydrocarbon radical of 6 to 22 carbon atoms, preferably alkyl or alkenyl, each of 6 to 22, preferably 12 to 18, carbon atoms, one of $V_1$ and $V_2$ is hydrogen or methyl and the other is hydrogen, Z is hydrogen or alkyl of 1 to 4 carbon atoms, preferably methyl or ethyl, and n is 1 to 4, preferably 2 or 3. The ester group —COOR can be in the ortho-, meta- or para-position. The ester group —COOR is preferably in the ortho-position and so forms orthophthalic acid diesters.

The preferred meaning of R in formula (1) is alkyl of 8 to 22, preferably 12 to 18, carbon atoms, and each of $V_1$ and $V_2$ is preferably hydrogen. Z is preferably hydrogen.

Further particulars on the composition of the mixed phthalic acid esters suitable for use as the vehicle (b), including the preparation thereof, are disclosed in German Offenlegungsschrift No. 2 843 412.

In this invention, the amounts in which the phthalic acid diesters are used vary preferably from 2 to 30% by weight, most preferably from 3 to 20% by weight, based on the weight of the composition.

The vehicle is preferably solid and lipophilic. Desirably it should be able to dissolve the finishing agent (c) or, if (c) is insoluble, to keep it finely dispersed. The vehicle preferably dissolves the component (c) and is itself dissolved in the solvent (a). A suitable vehicle will be chosen in accordance with the nature of the finishing agent to be used and also in accordance with the end use of the composition of the invention. After application has been made, the vehicle normally acts as solid dissolving medium and, in particular, if the finishing agent (c) is not soluble in (a) and (b), as binder for the finishing agent, and it may also be used simultaneously as finishing agent (softener, dirt repellant, conditioning agent) for the textile material to be treated.

Particularly suitable vehicles for the composition of the invention are organosoluble synthetic resins, e.g. petroleum hydrocarbon resins, polyterpene resins, ester diol alkoxylates, ketone resins, polyamide resins, sulfonamide resins, silicone resins, isobutyraldehyde/formaldehyde resins, melamine/formaldehyde resins; homopolymers and copolymers of acrylic acid, methacrylic acid, acrylates, methacrylates, acrylamide, methacrylamide, ethylene, vinyl butyral, vinyl chloride, vinylidene chloride, vinyl alcohol, vinyl toluene, styrene, α-methyl styrene, vinyl acetate, vinyl acetate/vinyl laurate, and also vinyl acetal/vinyl acetate/vinyl alcohol terpolymers, polyolefins, polyepoxides, polyamides, polyaminoamides, polyurethanes, polyhydantoins, polycarbonates, polysulfones, modified polyvinylpyrrolidones, nitrocellulose; cellulose ethers, e.g. methyl cellulose, ethyl cellulose, hydroxyethyl cellulose, benzyl cellulose; cellulose esters, e.g. cellulose acetates, cellulose propionates, cellulose butyrates, cellulose acetobutyrates, as well as linear polyesters. Preferred resins are also acid resins, e.g. polyanhydride resins, as they can easily be removed again in alkaline washing processes.

For utilities in which finishes other than whitening are of interest, e.g. dyeing, conditioning etc., suitable polymers and resins (b) are also those which are not entirely colourless, such as rosin resins, alkyd resins, polyethylene waxes, phenol/formaldehyde resins and polybenzimidazoles. Such resins are described in more detail e.g. in the Coating Raw Materials Tables of Dr. Erich Karsten, 5th edition, 1972, Vincenz-Verlag, Hannover.

The amounts in which the synthetic resins are used in this invention vary preferably from 0.5 to 40% by weight, most preferably from 5 to 25% by weight, based on the weight of the composition.

Instead of, or preferably in combination with, neutral resins, suitable resins as component (b) are also phthalic acid monoesters which are obtained by esterification of orthophthalic acid with a fatty alcohol containing preferably 12 to 22 carbon atoms. Preferred phthalic acid monoesters have a softening point of at least 50° C. Examples of such carboxylic acid esters are monostearyl phthalates, monobehenyl phthalates and monoesters of phthalic acid and a mixture of $C_{10}$–$C_{14}$ fatty alcohols, e.g. the alfols. The phthalic acid monoesters are preferably also used in combination with the acid component (e) and, in particular, with stearic acid.

Depending on whether the phthalic acid monoesters are used alone as component (b) or in combination with the neutral resins and/or with component (e), the amounts in which they are used varies preferably from 2 to 20% by weight, most preferably from 3 to 15% by weight, based on the weight of the entire composition. The phthalic acid monoesters are not only used as component (b), but also for improving the washing off properties of the finishes applied in the practice of this invention, e.g. by an alkaline wash.

Suitable finishing agents which are sparingly soluble to insoluble in water (component (c)), are preferably fluorescent whitening agents as well as dyes, e.g. disperse dyes, metal complex dyes, or solvent-soluble dyes, finely dispersed lipophilic coloured and white pigments, antistatic agents, microbicides, odorous substances, tannins, UV absorbers, moth repellents, water repellents, fabric softeners, plasticisers or dirt repellents. Depending on the end use, these finishing agents can be used individually or in combination. Sparing solubility and insolubility will be understood as meaning a solubility of less than 0.05% at room temperature.

Particularly preferred finishing agents for the process of this invention are fluorescent whitening agents which are sparingly soluble in water and which are used preferably for manmade fibres, e.g. polyamide fibres, acrylic fibres and, in particular, polyester fibres. The fluorescent whitening agents may belong to any class of these compounds. In particular, they are coumarins, triazole coumarins, benzocoumarins, oxazines, pyrazines, pyrazolines, diphenyl pyrazolines; stilbenes, styryl stilbenes, triazolylstilbenes, bis-benzoxazolylethylenes, stilbene bis-benzoxazoles, phenylstilbene benzoxazoles, thiophene bis-benzoxazoles, naphthalene bis-benzoxazoles, benzofurans, benzimidazoles, furan bis-benzimidazoles and naphthalimides.

Mixtures of fluorescent whitening agents or of fluorescent whitening agents with blue to violet shading dyes can also be used in the process of this invention. The fluorescent whithening agents can also be used in combination with lipophilised white pigments, in which case the white pigments are incorporated in thermoplasts, e.g. polyester or polyamide, and are present in fine dispersion.

Further important finishing agents which can be used in this invention especially for keratin fibres (wool), are microbicides, e.g. halogenated hydroxydiphenyl ethers and moth repellents, e.g urea derivatives, or, in particular, 5-phenylcarbamoylbarbituric acid compounds and/or pyrethroids such as permethrin or cypermethrin.

Component (d) is water-soluble and preferably also soluble in the solvent (a). However, it may also only be dispersed in the solvent medium (a).

In the composition of this invention, it is preferred to use a water-soluble acid having a pK value of 1 to 6 as component (d). Examples of such acids are aliphatic monocarboxylic acids of 1 to 5 carbon atoms, e.g. formic acid, acetic acid, propionic acid, butyric acid, acrylic acid, methacrylic acid, dimethylacrylic acid, halogenated acetic acids such as monochloroacetic acid, dichloroacetic acid or trifluoroacetic acid, hydroxyacetic acid, glycolic acid or lactic acid; cycloaliphatic monocarboxylic acids such as cyclohexanecarboxylic acid; araliphatic carboxylic acids such as phenylacetic acid; aromatic monocarboxylic acids such as benzoic acid, naphthoic acid, salicylic acid, m- or p-hydroxybenzoic acid or nicotinic acid; aliphatic dicarboxylic or tricarboxylic acids such as oxalic acid, malonic acid, succinic acid, glutaric acid, adipic acid, citric acid, malic acid, maleic acid, methylmaleic acid; and also methanesulfonic acid, ethanesulfonic acid, trifluoromethanesulfonic acid, benzenesulfonic acid, alkylbenzenesulfonic acid, e.g. dodecylbenzenesulfonic acid, citraconic anhydride, sulfamic acid or phosphoric acid, as well as monoalkyl or dialkyl ester of phosphoric acid, the alkyl moieties of which esters may contain 1 to 12, preferably 3 to 8, carbon atoms.

The acids specified above may also be used in admixture with acid or acid-hydrolysing salts of such acids, e.g. the corresponding ammonium salts, or also the corresponding alkali metal salts as well as with further water-soluble acids or neutral inorganic salts, e.g. potassium hydrosulfate, sodium hydrosulfate, ammonium hydrogen sulfate, diammonium sulfate, diammonium phosphate, disodium hydrophosphate, sodium dihydrophosphate or potassium dihydrophosphate. If desired, the acid or acid-hydrolysing salts may be used instead of the free acids. It is particularly advantageous to use as component (d) the stronger aliphatic carboxylic acids, i.e. mono- or dicarboxylic acids containing not more than 6 carbon atoms, e.g. formic acid, acetic acid, mono- or dichloroacetic acid, oxalic acid, malonic acid, succinic acid, glutaric acid, adipic acid or mixtures thereof. The preferred acids are formic acid, acetic acid or a mixture of dicarboxylic acids comprising succinic acid, glutaric acid and adipic acid. Also preferred are acid phosphoric acid esters, e.g. the monoalkyl and/or dialkyl esters of phosphoric acid mentioned above.

The amount of acid used as component (d) usually depends on the strength of the acid, i.e. on the degree of dissociation of the acid. In general, amounts of 3 to 15% by weight, preferably 5 to 10% by weight, based on the total composition have proved suitable.

The acid (d) is used in particular for adjusting the pH value of the aqueous liquors which are prepared with the compositions of the present invention. The pH of these liquors is usually in the range from 2 to 6, preferably from 3 to 5.5.

The addition of the acid component (d) to the compositions of the invention substantially increases the rate of exhaustion of these novel formulations. Accordingly, higher whiteness levels as a result of intense fluorescence are obtained when using formulations containing fluorescent whitening agents. Correspondingly good results are also obtained, however, by adding component (d) separately to the aqueous application bath instead of to the composition.

The carboxylic acids which are sparingly soluble in water and suitable for use as component (e) are, in particular, fatty acids which preferably contain 8 to 24, most preferably 12 to 22, carbon atoms, and may be unsaturated or preferably saturated, e.g. caprylic acid, pelargonic acid, capric acid, lauric acid, myristic acid, palmitic acid, stearic acid, arachinic acid, coconut ($C_{10}$–$C_{16}$) fatty acid, tallow fatty acid, behenic acid, lignoceric acid, decenoic acid, dodecenoic acid, tetradecenoic acid, hexadecenoic acid, oleic acid, linolic acid, linolenic acid, ricinolic acid, eicosenoic acid, docosenoic acid, hiragonic acid, eleostearic acid, licanoic acid, parinaric acid, arachidonic acid or clupadonic acid.

Further carboxylic acids which can be used as component (e) in the practice of this invention are abietic acid, anisic acid, gallic acid, cinnamic acid, phthalic acid or trimellitic acid. Preferred carboxylic acids as component (e) are lauric acid, palmitic acid, behenic acid or, in particular, stearic acid. Component (e) is preferably used in combination with the neutral resin employed as component (b). In certain cases, the carboxylic acid (e) may also be used as vehicle (b). Component (e) is used in particular for improving the ease with which the finishes obtained in the practice of this invention can be removed by an alkaline washing-off.

The amounts in which the sparingly water-soluble carboxylic acid (e) is used preferably vary from 2 to 15% by weight, most preferably from 4 to 10% by weight, based on the total weight of the composition.

In addition, the compositions of this invention may contain, as polar solvent (f), water or a water-miscible organic solvent. The addition of this solvent is made to improve the dispersion of the composition in aqueous media in application, i.e. to disperse the droplets of the organic phase more finely so that they do not coalesce too rapidly. Examples of water-miscible organic solvents are aliphatic $C_1$–$C_3$ alcohols such as methanol, ethanol or the propanols; alkylene glycols such as ethylene glycol or propylene glycol; monoalkyl ethers of glycols such as ethylene glycol monomethyl, monoethyl, or monobutyl ether, and diethylene glycol monomethyl or monoethyl ether; ketones such as acetone or diacetone alcohol; ethers such as diisopropyl ether, diphenyl oxide, dioxan, tetrahydrofuran, and also tetrahydrofurfuryl alcohol, pyridine, acetonitrile, N-methylpyrrolidone, γ-butyrolactone, N,N-dimethylformamide, N,N-dimethylacetamide, tetramethylurea, tetramethylene sulfone. Mixtures of these solvents can also be used.

Preferred compositions of this invention comprise at least the following components:

(Aa) an organic solvent which is sparingly soluble or insoluble in water and has a flash point above 50° C., (Bb) an organosoluble synthetic resin and/or a phthalic acid mono- or diester or a mixture thereof, (Cc) a fluorescent whitening agent which is sparingly soluble in water, and (Dd) an aliphatic mono- or dicarboxylic acid containing not more than 6 carbon atoms, or a mixture of such acids.

As component (Dd), it is also possible to use phosphoric acid esters, e.g. mono- or dialkyl esters containing 1 to 12, preferably 3 to 8 carbon atoms in the alkyl moieties.

In addition to components (a), (b), (c), (d) and optionally (e) and (f), the compositions of this invention may also contain chelating agents and/or small amounts of anionic, cationic, amphoteric or non-ionic surfactants.

Suitable chelating agents are inorganic complex-forming compounds e.g. water-soluble polyphosphates, polymetaphosphates or pyrophosphates, and preferably their alkali metal salts and magnesium salts, as well as organic complex-forming compounds such as basic nitrogen compounds which contain at least two phosphonatomethyl or carboxymethyl groups bonded to nitrogen, which groups may be further substituted. These nitrogen compounds are aminoalkyleneacetic acids, aminocycloalkyleneacetic acids and aminocycloalkylenephosphonic acids, N-sulfoalkaneaminophosphonic acids, e.g. nitrilotriacetic acid, ethylenediaminetetraacetic acid, β-(hydroxyethyl)ethylenediaminetriacetic acid, cyclohexylenediaminetetraacetic acid, diethylenetriaminepentaacetic acid and nitrilotris(methylene)triphosphonic acid, 1-aminoethane-1,1-diphosphonic acid, N-sulfoethane-1-aminoethane-1,1-diphosphonic acid, 1-hydroxy-3-aminopropane-1,1-diphosphonic acid, ethylenediaminetetra(methylene)phosphonic acid, hexamethylenediaminetetra(methylene)phosphonic acid and the water-soluble salts, e.g. sodium or magnesium salts, of these acids.

Further organic complexing agents are e.g. hydroxylated polycarboxylic acids such as citric acid or gluconic acid, as well as water-soluble homopolymers or acrylic acid or maleic acid, preferably polymaleic anhydride, and also copolymers of acrylic acid with methacrylic acid, methacrylonitrile, acrylates, methacrylates and copolymers of maleic acid and a vinyl ether, and preferably their water-soluble or alkali metal salts or ammonium salts.

Very suitable chelating agents are nitrilotriacetic acid, ethylenediaminetetraacetic acid, diethylenetriaminepentaacetic acid, gluconic acid and the salts thereof. Preferred chelating agents are alkali metal hexametaphosphates and, in particular, sodium hexametaphosphate.

The amounts in which the chelating agent is added to improve the stability of the composition are conveniently from 1 to 10% by weight, preferably from 2 to 6% by weight, based on the weight of the composition.

Suitable surfactants are preferably non-ionic or cationic surfactants. The non-ionic surfactants are used primarly for weakly emulsifying the organic phase.

The anionic surfactants are in particular derivatives of alkylene oxide adducts, e.g. polyadducts of alkylene oxides, preferably of ethylene oxide and/or propylene oxide and also styrene oxide, with organic hydroxyl, carboxyl, amino and/or amido compounds containing aliphatic hydrocarbon radicals having a total of at least 4 carbon atoms, e.g. higher fatty alcohols, fatty acids, fatty amines, fatty acid amides or alkylphenols or mixtures of these compounds, which adducts are preferably sulfated and contain acid ether groups, or preferably acid ester groups, of organic or inorganic acids. These adducts can have a degree of alkoxylation of about 2 to 100, and contain especially 5 to 40 ethoxy and/or propoxy groups. The acid ethers or esters can be in the form of free acids or salts, e.g. alkali metal salts, alkaline earth metal salts, ammonium salts or amine salts. Preferred anionic surfactants are alkylarylsulfonates with straight chain or branched alkyl chain containing at least 6 carbon atoms in the alkyl moiety, e.g. nonyl- or dodecylbenzenesulfonates or diisobutylnaphthalenesulfonates, as well as sulfonates of dicarboxylic acid esters, e.g. dioctyl sulfosuccinate.

The cationic surfactants may contain, as basic substituents, e.g. amino, imino, quaternary ammonium or immonium, tertiary phosphino, quarternary phosphonium or sulfonium groups, and also thioronium or guanidinium groups. Preferred basic substituents are tertiary amino groups and, in particular, quaternary ammonium groups. These preferably contain aliphatic, cycloaliphatic or araliphatic groups as N-substituents. The N-substituents may also form 5- to 8-membered, especially 6-membered, N-heterocyclic ring systems.

Particularly suitable cationic surfactants which may be used in the practice of this invention are quaternary ammonium compounds of the formula

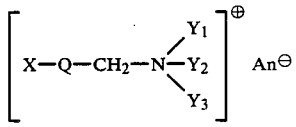

(2)

wherein X is an aliphatic hydrocarbon radical of 6 to 22, preferably of 10 to 18, carbon atoms, or a cycloaliphatic radical of 5 to 12 carbon atoms, each of $Y_1$ and $Y_2$ is lower alkyl, preferably methyl or ethyl, or both together with the nitrogen atom to which they are attached form a 5- or 6-membered saturated heterocyclic radical, e.g. pyrrolidino, piperidino or morpholino, $Y_3$ is lower alkyl, hydroxy-lower alkyl, cyano-lower alkyl, carbamoyl-lower alkyl or aralkyl such as benzyl, or $Y_1$, $Y_2$ and $Y_3$, together with the nitrogen atom to which they are attached, form a pyridine ring which is unsubstituted or substituted by lower alkyl, Q is the direct bond or oxygen, and $An^{\ominus}$ is the anion of an organic or inorganic acid, e.g. the chloride, bromide or methanesulfonate ion.

Lower alkyl generally denotes those groups or moieties of groups which contain 1 to 5, in particular 1 to 3, carbon atoms, e.g. methyl, ethyl, n-propyl, isopropyl, sec-butyl, tert-butyl or amyl.

Particularly preferred quaternary ammonium compounds are n-dodecyloxymethyltrimethylammonium chloride, n-dodecyltrimethylammonium chloride and, most particularly N-cocosyl N,N-dimethyl-N-benzylammonium chloride or N-cocosyl N,N-di-2-hydroxyethyl-N-benzylammonium chloride.

Further cationic surfactants are the quaternary polyammonium polymers which are described in German Offenlegungsschrift specifications Nos. 2 657 582, 2 824 743, 2 840 785 and 2 857 180.

Suitable cationic surfactants are also amines or polyamines which contain 2 or more, preferably 2 to 5, basic nitrogen atoms, and which contain at least one polyglycol ether chain and at least one lipophilic substituent (e.g. alkenyl or alkyl, each of 8 to 22 carbon atoms) and which can be partially or completely quaternised.

Examples of suitable amphoteric surfactants are amines or polyamines which contain 2 or more, preferably 2 to 5, basic nitrogen atoms and at least one acid, etherified or esterified polyglycol ether chain and at least one lipophilic substituent, and which can be partially or completely quaternised. Especially preferred amphoteric surfactants are the acid monosulfuric acid esters of adducts of 1 mole of a fatty amine or mixture of fatty amines, e.g. of tallow fatty amine, with 2 to 15 moles of ethylene oxide.

The non-ionic surfactants are preferably adducts of 1 to 50 moles of alkylene oxide, e.g. ethylene oxide and/or propylene oxide, with 1 mole of an aliphatic monoalcohol containing at least 6 carbon atoms, preferably 8 to 22 carbon atoms, of a trihydric to hexahydric aliphatic alcohol containing 3 to 6 carbon atoms, of a phenol which is unsubstituted or substituted by alkyl, benzyl or phenyl, or of a fatty acid containing 8 to 22 carbon atoms. It is also preferred to use block polymers of ethylene oxide and propylene oxide. These block polymers preferably have the formulae $$HO(C_2H_4O)_{m1}—(C_3H_6O)_y—(C_2H_4O)_{m2}H \quad (3)$$

or $$HO(C_3H_6O)_{y1}—(C_2H_4O)_m—(C_3H_6O)_{y2} \quad (4)$$

and may have a molecular weight of 2000 to 10,000. The content of ethylene oxide ($m_1+m_2$ or m) is 10 to 85% by weight, and the propylene oxide content (y or $y_1+y_2$) is 15 to 90% by weight.

Non-ionic surfactants which are especially preferred as emulsifiers are adducts of 2 to 15 moles of ethylene oxide and 1 mole of fatty alcohol or fatty acid, each of 8 to 18 carbon atoms, or 1 mole of alkylphenol containing 4 to 12 carbon atoms in the alkyl moiety.

The use of adjusted amounts of surfactant permits the organic liquor to exhaust more slowly and more levelly onto the lipophilic substrate.

The anionic, amphoteric and non-ionic surfactants are preferably used in an amount of 0.1 to 1% by weight, based on the entire composition, whereas the cationic surfactants are used in an amount of up to 15% by weight, but preferably up to at most 3% by weight.

If desired, non-reactive or weakly reactive lipophilised pigments may also be used, with or without surfactants as assistants. Examples of such pigments are: talcum, titanium dioxide, zinc oxide, zinc sulfide, chalk, clays such as kaolin, as well as organic pigments, e.g. urea/formaldehyde or melamine/formaldehyde condensates. Particularly preferred pigments are those white pigments which are lipophilised and simultaneously whitened by coating them with a fluorescent whitening agent which is incorporated in a polymer, e.g. polyester.

The compositions of the invention can be prepared by simple stirring of the components (a), (b), (c), (d) and optionally (e), (f) and/or surfactants, if appropriate with gentle heating, to give homogeneous mixtures which are storage stable at room temperature.

The compositions of the invention conveniently comprise 10 to 95% by weight, preferably 20 to 80% by weight, of component (a),
2 to 40% by weight of component (b),
0.1 to 20% by weight of component (c),
2 to 20% by weight of component (d),
0 to 15% by weight, preferably 4 to 10% by weight of component (e)
0 to 90% by weight, preferably 10 to 75% by weight, of component (f),
0 to 3% by weight of an anionic, cationic, amphoteric and/or non-ionic surfactant,
0 to 10% by weight, preferably 2 to 6% by weight, of a chelating agent, in each case based on the weight of the entire composition.

These compositions are preferably stable liquid formulations which, depending on the formulation, can be used undiluted or diluted in the form of solutions, with components (a) and (f) being suitable solvents. When prediluted with water or water-soluble organic or inorganic acids, they can also be used as liquid two-phase system.

If the compositions of the invention contain fluorescent whitening agents as finishing agents, the novel formulations can be employed for whitening synthetic, regenerated or natural organic fibre materials of the most diverse kind which may be in the form of filaments, fibres, flocks or bonded fibre webs. The compositions are preferably used for treating, especially for whitening, organic fibre material, in particular synthetic fibre material, to give improved whiteness resulting from the addition of acid.

Suitable fibre material which may be whitened with the compositions of the invention comprises e.g. manmade fibres of natural polymers of (i) vegetable origin, e.g. cellulosic fibres such as acetate and triacetate fibres, and vegetable protein fibres, and (ii) of animal fibres such as animal protein fibres.

Preferred fibres are manmade fibres of synthetic polymers such as polycondensate fibres (polyester, polyurea and polyamide fibres), polymer fibres (polyamide, polyacrylonitrile, modacrylic, polypropylene, polyvinyl acetal, polyvinyl chloride, polyvinylidene chloride, polyfluoroethylene fibres), polyaddition fibres (such as polyurethane fibres).

In particular, the compositions of the invention are used for whitening linear polyester fibres. By linear polyester fibres are meant synthetic fibres which are obtained e.g. by condensation of terephthalic acid with ethylene glycol or of isophthalic acid or terephthalic acid with 1,4-bis(hydroxymethyl)cyclohexane, as well as copolymers of terephthalic acid and isophthalic acid and ethylene glycol.

The substrates to be treated can in certain cases also be obtained from conventional natural fibre material, e.g. from cotton, hemp, linen, jute, ramie, silk or, in particular, wool.

The fibre materials can be used as blends with each other or with other fibres, e.g. acrylic/polyester blends, polyamide/polyester blends, polyester/wool blends and, provided the amount of the cellulose component is not greater, polyester/cotton and polyester/viscose staple fibre blends.

The textile material to be treated can be in different states of processing, e.g. loose material, knitted goods such as knits and wovens, yarns in package or muff form. It is preferred to treat finished goods, e.g. curtains and underwear.

The amounts in which the compositions of the invention are added to the treatment liquors, e.g. whitening baths or mothproofing formulations, vary from 1 to 40% by weight, preferably from 5 to 25% by weight, based on the weight of the substrate, or from 0.1 to 100 g, preferably 0.5 to 25 g, per liter of treatment liquor.

Depending on the desired effect, the treatment liquors may contain additional additives and assistants, e.g. bleaching agents, oxidants, light stabilisers, acids or acid-hydrolysing salts, antioxidants, thickeners, fillers and/or finishing agents.

Treatment is preferably carried out from an aqueous bath by the exhaust method. The liquor ratio may accordingly be chosen within a wide range, e.g. 1:4 to 1:100, preferably 1:20 to 1:70. The pH of the treatment bath is conveniently in the range form 2 to 6, preferably from 3 to 5.5.

The temperature at which the substrate is treated is normally in the range from 10° to 96° C., preferably from 15° to 40° C.

If desired, the whitening step can be combined with a prewash, in which the substrate is treated before the whitening procedure with an aqueous liquor which contains a conventional detergent, and then carefully rinsed.

The process of this invention gives substrates which have the desired finish.

The invention is illustrated by the following Examples, in which percentages are by weight, unless otherwise stated.

EXAMPLE 1

A polyester curtain having a weight of 1000 g is put into a washing machine and given a normal wash at 40° C. for 20–30 minutes with a curtain detergent and rinsed. The curtain is then treated for 10 minutes at room temperature with an aqueous liquor (liquor ratio 1:40) which contains 100 g of a composition (1) consisting of:

38.2% of aliphatic hydrocarbons with a boiling point in the range from 185°–210° C.,
30.0% of diethyl succinate,
8.0% of monobehenyl phthalate,
10.0% of a copolymer of vinyl toluene and α-methyl styrene with a softening point of 118° C.,
0.5% of an adduct of 9 moles of ethylene oxide and 1 mole of oleyl alcohol,
8.0% of acetic acid (99%),
0.3% of a fluorescent whitening agent of the formula

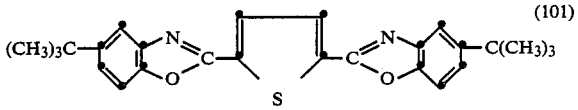

and 5.0% of a 0.1% solution of a shading dye of the formula

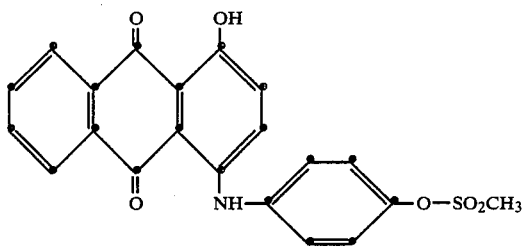

in diethyl succinate.

The pH of the liquor is 4.5–5. The curtain is then centrifuged and dried in the air. A pure white curtain with a dry, slightly stiff handle is obtained. The curtain exhibits an intense bluish white fluorescence in UV light.

EXAMPLE 2

The procedure of Example 1 is repeated, using instead of composition (1) equal amounts of a composition (2) consisting of:

36.2% of aliphatic hydrocarbons (boiling point: 185°–210° C.),
32.0% of diethyl succinate,
3.0% of diacetone alcohol,
8.0% of stearic acid,
10.0% of a copolymer of vinyl toluene and α-methyl styrene with a softening point of 118° C.,
0.5% of an adduct of 9 moles of ehtylene oxide and 1 mole of oleyl alcohol,
10.0% of an acid mixture consisting of 2.9% of phosphoric acid, 34.8% of monobutyl phosphate, 57.7% of dibutyl phosphate and 4.6% of butanol/tributyl phosphate/water, and
0.3% of the fluorescent whitening agent of the formula (101).

After drying, similarly good white effects are obtained on the curtain. A still more pronounced white effect is obtained by the further addition of 0.005% of the shading dye of the formula (102) to the composition.

EXAMPLE 3

The procedure of Example 1 is repeated, using 100 g of a composition (3) consisting of:

41.2% of aliphatic hydrocarbons (boiling range: 186°–214° C.),
30.0% of diethyl succinate,
8.0% of monostearyl phthalate,
10.0% of a copolymer of vinyl toluene and α-methyl styrene with a softening point of 118° C.,
0.5% of an adduct of 9 moles of ethylene oxide and 1 mole of p-nonylphenol, partially esterified with phosphoric acid,
0.3% of the fluorescent whitening agent of the formula (101), 10.0% of a mixture of dicarboxylic acids comprising glutaric acid, succinic acid and adipic acid, A very pure white curtain is obtained after drying.

Very substantially improved white effects are also obtained by treating a polyamide 6, polyamide 66 or acrylic fibre curtain in the same manner in the aqueous rinsing liquor.

The treatment liquors employed in Examples 2 and 3 have pH values in the range from 4.5 to 5.5.

EXAMPLE 4

A soiled polyester curtain weighing 1000 g is washed in a washing machine as in Example 1 and then rinsed. The curtain is then given an additional rinse by treating it for 10 minutes at room temperature with an aqueous liquor (liquor ratio 1:30) which contains 200 g of a composition (4) consisting of:

54.2% of diethyl succinate, 25.0% of benzyl alcohol, 12.0% of a monoester of phthalic acid and a $C_{10}$–$C_{14}$ fatty alcohol, 8.0% of formic acid (98%), 0.5% of an adduct of 9 moles of ethylene oxide and 1 mole of oleyl alcohol, 0.3% of a fluorescent whitening agent of the formula (103)

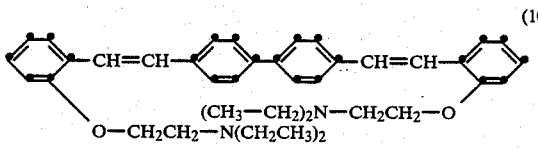

The pH of the liquor is 4.5.

Following this treatment the curtain is dried. A whitened curtain with a full soft handle is obtained. The white effect is very level.

EXAMPLE 5

A polyester curtain weighing 1000 g is put into a washing machine and given a normal wash for 20–30 minutes at 40° C. with a curtain detergent and then rinsed. The curtain is then treated for 10 minutes at room temperature with an aqueous liquor (liquor ratio 1:30) which contains 150 g of a composition (5) consisting of:

38.2% of aliphatic hydrocarbons (boiling range: 190°–240° C.,)

30.05 of diethyl succinate, 10.0% of a thermoplastic aromatic copolymer resin with a melting point of 120° C., 6.0% of lauric acid, 5.0% of precipitated calcium carbonate, 10.0% of monosodium dihydrogen phosphate, 0.3% of the fluorescent whitening agent of the formula (101), and 0.5% of an adduct of 9 moles of ethylene oxide and 1 mole of oleyl alcohol.

The curtain is centrifuged and dried in the air. A pure curtain with an excellent white effect is obtained.

Similarly good results are obtained using equal amounts of sodium hydrogen sulfate, sulfamic acid or ammonium chloride instead of monosodium hydrogen phosphate.

EXAMPLE 6

A polyester curtain weighing 1000 g is washed in a washing machine as in Example 1, rinsed, and then treated in the final rinse with 150 g of a composition (6) consisting of:

38.22% of aliphatic hydrocarbons (boiling range: 190°–240° C.), 30.00% of diethyl succinate, 10.00% of a thermoplastic aromatic copolymer resin, m.p. 120° C., 6.00% of stearic acid, 15.00% of precipitated calcium carbonate (microdispersed)

0.28% of the fluorescent whitening agent of the formula (101), 0.50% of an adduct of 9 moles of ethylene oxide and 1 mole of oleyl alcohol.

Simultaneously with the addition of composition (6), 5 g of 99% acetic acid are also added to the rinse compartment so as to ensure that the treatment liquor is acidified. The pH of the liquor is 5. After treatment for 10 minutes at room temperature, a levelly whitened curtain with a very good white effect and a soft handle is obtained. Instead of acetic acid, it is also possible to use another acid, e.g. formic acid, lactic acid or sulfamic acid.

EXAMPLE 7

A polyester curtain weighing 1000 g is put into a washing machine and given a normal wash for 20–30 minutes at 40° C. with a curtain detergent and then rinsed. The curtain is then treated for 10 minutes at room temperature with an aqueous liquor (liquor ratio 1:40) which contains 120 g of a composition (7) consisting of:

8.0% of aliphatic hydrocarbons (boiling range: 193°–247° C.), 27.0% of diethyl succinate, 8.0% of a copolymer of vinyl toluene and α-methyl styrene with a softening point of 118° C., 6.25% of monobehenyl phthalate, 0.5% of an adduct of 9 moles of ethylene oxide and 1 mole of p-nonylphenol, partially esterified with phosphoric acid, 0.25% of the fluorescent whitening agent of the formula (101), 5.0% of a mixture of dicarboxylic acids comprising glutaric acid, succinic acid and adipic acid, 5.0% of sodium hexametaphosphate, and 40.0% of deionised water.

The liquor has a pH of 5. The curtain is then centrifuged and dried in the air. A curtain with an excellent white effect is obtained. Excellent level, improved white effects are also obtained by treating a curtain made of polyamide 6, polyamide 66, cellulose acetate, acrylic, polyvinyl chloride or polypropylene fibres in the aqueous rinsing liquor in the same manner.

EXAMPLE 8

The procedure of Example 7 is repeated, using equal amounts of a composition containing 5% of the disodium salt of ethylenediaminetetracetic acid instead of 5% of sodium hexametaphosphate. A very white curtain is also obtained after drying.

EXAMPLE 9

The procedure of Example 7 is repeated, using equal amounts of a composition containing 7% instead of 5% of the mixture of dicarboxylic acids and 3% of the sodium salt of nitrilotriacetic acid instead of 5% of sodium hexametaphosphate. A very white curtain is also obtained after drying.

EXAMPLE 10

The procedure of Example 7 is repeated, using equal amounts of a composition containing 7% instead of 5% of the mixture of dicarboxylic acids and 3% of sodium gluconate instead of 5% of sodium hexametaphosphate. A very white curtain is also obtained after drying.

EXAMPLE 11

The procedure of Example 7 is repeated, using equal amounts of a composition containing 7% instead of 5% of the mixture of dicarboxylic acids and 3% of the sodium salt of diethylenetriaminepentaacetic acid instead of 5% of sodium hexametaphosphate. A very white curtain is also obtained after drying.

What is claimed is:

1. A stable composition for treating textile substrates, which composition comprises at least (a) an organic solvent which is sparingly soluble or insoluble in water and in which component (b) is dissolved and components (c) and (d) are dissolved or dispersed, (b) a vehicle for component (c) which is sparingly soluble or insoluble in water, (c) a fluorescent whitening agent which is sparingly soluble or insoluble in water and which is soluble or dispersible in the vehicle (b), and (d) a water-soluble acid having a pK value greater than 1.

2. A composition according to claim 1, additionally comprising a solid carboxylic acid which is sparingly soluble in water as component (e).

3. A composition according to claim 1, additionally comprising a polar solvent as component (f).

4. A composition according to claim 1, wherein component (a) is selected from aliphatic hydrocarbons with a flash point above 50° C., alkylbenzenes, hexanol, 2-ethylhexanol, oleyl alcohol, benzyl alcohol, phenoxyethanol, ethylene glycol dibutyl ether, dialkyl ketones containing a total of 6 to 12 carbon atoms, acetates, dimalonates, disuccinates, benzoates, perchloroethylene, or a mixture thereof.

5. A composition according to claim 1, wherein component (a) is selected from aliphatic hydrocarbons with a flash point above 50° C. and a boiling range from 175°-260° C., perchloroethylene, diethyl malonates, diethyl succinates, butyl benzoates, benzyl alcohol, phenoxyethanol, or a mixture thereof.

6. A composition according to claim 1, wherein the vehicle (b) is solid and lipophilic.

7. A composition according to claim 1, wherein component (c) is dissolved in the vehicle (b), which in turn is dissolved in the solvent (a).

8. A composition according to claim 1, wherein the vehicle (b) is an organosoluble synthetic resin or a polymer.

9. A composition according to claim 1, wherein the vehicle (b) is a phthalic acid monoester of a fatty alcohol containing 10 to 22 carbon atoms.

10. A composition according to claim 1, wherein the vehicle (b) is a phthalic acid diester, the ester moieties of which are derived from alkanols containing 1 to 9 carbon atoms.

11. A composition according to claim 1, wherein the vehicle (b) is a mixed phthalic acid diester, one ester moiety of which is derived from a fatty alcohol containing 6 to 22 carbon atoms and the other from an alkylene glycol or alkylene glycol monoalkyl ether.

12. A composition according to claim 1, wherein the fluorescent whitening agent (c) is sparingly water-soluble.

13. A composition according to claim 12, which contains the fluorescent whitening agent in combination with a shading dye.

14. A composition according to claim 1, wherein component (d) is a water-soluble acid having a pK value from 1 to 6.

15. A composition according to claim 14, wherein component (d) is an aliphatic mono- or dicarboxylic acid containing not more than 6 carbon atoms or a mixture of such acids.

16. A composition according to claim 15, wherein the component (d) is acetic acid or a mixture of dicarboxylic acids selected from succinic acid, glutaric acid and adipic acid.

17. A composition according to claim 1, which comprises at least (Aa) an organic solvent which is sparingly soluble or insoluble in water and has a flash point above 50° C., (Bb) an organosoluble synthetic resin, a phthalic acid monoester or a phthalic acid diester or a mixture thereof, (Cc) a fluorescent whitening agent which is sparingly soluble in water, (Dd) an aliphatic mono- or dicarboxylic acid containing not more than 6 carbon atoms or a mixture of such acids.

18. A composition according to claim 2, wherein component (e) is a fatty acid containing 8 to 24 carbon atoms.

19. A composition according to claim 17, wherein the fatty acid contains 12 to 22 carbon atoms.

20. A composition according to claim 1, which additionally contains a chelating agent.

21. A composition according to claim 20, wherein the chelating agent is a water-soluble polyphosphate, polymetaphosphate or pyrophosphate, or a basic nitrogen compound which contains at least two phosphonatemethyl or carboxymethyl groups bonded to nitrogen.

22. A composition according to claim 20, wherein the chelating agent is an alkali metal salt of nitrilotriacetic acid, ethylenediaminetetraacetic acid, diethylenetriaminepentaacetic acid or gluconic acid.

23. A composition according to claim 20, wherein the chelating agent is sodium hexametaphosphate.

24. A composition according to claim 1, which additionally contains an anionic, cationic, amphoteric or non-ionic surfactant.

25. A composition according to claim 24, which contains a cationic surfactant.

26. A composition according to claim 25, wherein the cationic surfactant is a quaternary ammonium compound of the formula

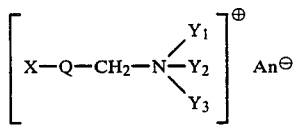

(2)

wherein

X is an aliphtic hydrocarbon radical of 6 to 22 carbon atoms, or a cycloaliphatic radical of 5 to 12 carbon atoms, each of $Y_1$ and $Y_2$ is lower alkyl, or both together with the nitrogen atom to which they are attached, form a 5- or 6-membered saturated heterocyclic radical, $Y_3$ is lower alkyl, hydroxy-lower alkyl, cyano-lower alkyl, carbamoyl-lower alkyl or aralkyl, or $Y_1$, $Y_2$ and $Y_3$, together with the nitrogen atom to which they are attached, form a pyridine ring which is unsubstituted or substituted by lower alkyl, Q is the direct bond or oxygen, and An $\ominus$ is the anion of an organic or inorganic acid.

27. A composition according to claim 24, wherein the non-ionic surfactant is an adduct of 2 to 15 moles of ethyleneoxide and 1 mole of a $C_8$–$C_{18}$ fatty alcohol, a $C_8$–$C_{18}$ fatty acid or an alkylphenol containing 4 to 12 carbon atoms in the alkyl moiety.

28. A composition according to claim 1, which contains, based on the entire composition, 20 to 80% by weight of component (a), 2 to 40% by weight of component (b), 0.1 to 20% by weight of component (c), 2 to 20% by weight of component (d)

0 to 15% by weight of component (e), 0 to 90% by weight of component (f), 0 to 3% by weight of an anionic, cationic, amphoteric or non-ionic surfactant or a mixture thereof, and 0 to 10% by weight of a chelating agent.

29. A process for treating a textile substrate, which comprises applying to said substrate a composition as claimed in claim 1.

30. A process according to claim 29, which comprises the use of a composition containing a fluorescent whitening agent for whitening synthetic, regenerated or natural organic fibre materials.

31. A process according to claim 30 for whitening synthetic fibre material.

32. A process according to claim 31 for whitening polyester fibre material.

33. A process according to claim 32 for whitening curtains made of polyester material.

34. A process according to claim 29, wherein the composition is applied to the textile substrate in aqueous medium.

35. A process according to claim 34, wherein the aqueous medium has a pH of 2 to 6.

36. A process according to claim 34, wherein the aqueous medium has a pH of 3 to 5.5.

37. A process according to claim 29, wherein the composition is used in an amount of 1 to 40% by weight, based on the substrate, or of 0.1 to 100 g per liter of treatment liquor.

38. A process according to claim 29, wherein the treatment of the substrate is carried out in the temperature range from 10° to 96° C.

39. A process according to claim 38, wherein the temperature range is from 15° to 40° C.

* * * * *